United States Patent [19]

Nutt et al.

[11] Patent Number: 4,745,831

[45] Date of Patent: May 24, 1988

[54] SETTING TOOL FOR SCREWING-IN THREADED RODS

[75] Inventors: Hubert Nutt, Mauren; Norbert Hilty, Schann, both of Liechtenstein

[73] Assignee: Hilti Aktiengesellschaft, Liechtenstein

[21] Appl. No.: 909,767

[22] Filed: Sep. 19, 1986

[30] Foreign Application Priority Data

Sep. 19, 1985 [DE] Fed. Rep. of Germany ..... 3533396

[51] Int. Cl.[4] ..... B25B 13/50; B25B 21/00

[52] U.S. Cl. ..... 81/53.2; 81/57.33; 279/4; 279/7

[58] Field of Search ..... 81/53.2, 54, 57.33; 279/4, 7; 408/239 R; 269/25, 27, 30, 31, 316, 317

[56] References Cited

U.S. PATENT DOCUMENTS 4,019,378 4/1977 Keller et al. ..... 279/4

FOREIGN PATENT DOCUMENTS 144735 5/1921 United Kingdom ..... 81/53.2

1375892 11/1974 United Kingdom .

*Primary Examiner*—Frederick R. Schmidt
*Assistant Examiner*—William E. Terrell
*Attorney, Agent, or Firm*—Toren, McGeady & Assocates

[57] ABSTRACT

A setting tool for screwing a threaded rod into a receiving material includes a work driver formed by a sleeve-like member. A retainer part is secured within one end of the sleeve-like member for holding the threaded rod while it is inserted. The end of the threaded rod located in the retainer part bears against a piston positioned within the sleeve-like member. A hydraulic medium holds the piston against the end of the threaded rod so that the rod is held in the work driver. After a threaded rod has been set, the rod can be removed from the retainer part by relieving the pressure of the hydraulic medium acting on the piston. The pressure is built-up as the threaded rod is screwed into the receiving material. The pressure is released by opening a valve connected to the space in the sleeve-like member containing the piston and hydraulic medium.

4 Claims, 1 Drawing Sheet

SETTING TOOL FOR SCREWING-IN THREADED RODS

BACKGROUND OF THE INVENTION

The present invention is directed to a setting tool for screwing a threaded rod into a receiving material with the tool including a sleeve-like member having a retainer part inserted in one end so that a rod to be inserted can be secured within a threaded bore in the retainer part. The sleeve-like member forms part of a work driver which transmits rotational movement through the retainer part to the threaded rod. The sleeve-like member contains a stop limiting the extent to which the threaded rod is screwed into the retainer part. By releasing the stop the threaded rod can be removed from the retainer part.

Mechanically driven setting tools are known for screwing a threaded rod into a receiving material into which the threaded rod is screwed into a member for carrying out the setting procedure with the rod axially abutting a stop. The resistance developed as the threaded rod is screwed into a receiving material causes the end of the rod to bear tightly against the stop.

In one known setting tool, used for screwing a threaded rod into a borehole containing an adhesive cartridge, the stop is in the form of a bolt which extends through the projection of a threaded bore in which the threaded rod is held. The bolt is cylindrically shaped but has a flattened area which can be placed into the axial projection of the threaded rod for releasing the holding action afforded by the stop. The release of the stop is effected by rotating the bolt. The movement of the stop into the release position is effected by means of a tool.

One considerable disadvantage of this known setting tool is the cumbersome handling involved due to the use of a tool for moving the stop into the release position along with the high force required in moving the stop into the release position.

SUMMARY OF THE INVENTION

Therefore, the primary object of the present invention is to provide a setting tool for screwing a threaded rod into a receiving material distinguished by easy handling of the tool.

In accordance with the present invention, the stop is formed as a piston located within a space where it is pressed by a hydraulic medium and with a valve controlling the flow of the hydraulic medium into and out of the space. While a threaded rod is being screwed into a receiving material the end of the rod within the setting tool is supported against the surface of the piston. The hydraulic medium, preferably oil, in a space within the setting tool affords a virtually incompressible abutment for the piston. A valve in the setting tool is maintained in the closed position while the threaded rod is inserted to prevent any flow of the hydraulic medium out of the space containing the piston.

To release a threaded rod bearing tightly against the piston, the valve is moved to an open position so that the hydraulic medium placed under pressure while the rod is screwed into the receiving material, is allowed to dissipate the pressure out of the space containing the piston. As a result, the piston assumes a release position with the bearing of the threaded rod against the piston being released when the pressure of the hydraulic medium is relieved.

Accordingly, the functional position of the piston is determined by the operation of the valve. The valve can be operated without any significant expenditure of force and it does not require any cumbersome manipulation by means of an auxiliary tool.

Preferably, the valve connects the space containing the piston with an equalizing or balancing space. The hydraulic medium in the piston containing space, under pressure due to the screwing in of the rod, is allowed to dissipate the developed pressure in the equalization space when the valve is moved into the open position so that the threaded rod can be released from the retainer part. Since the space containing the piston and the equalization space are enclosed within the work driver, the hydraulic medium initially filled into the driver is retained.

The equalization space is divided by a pressure piston into a space communicating through the valve with the piston containing space and another space containing an accumulator acting on the separating piston. When the valve is in the open position for releasing a threaded rod, the hydraulic medium is relieved by its communication with the equalization space and the pressure piston is biased counter to the direction in which the accumulator acts. The accumulator may be a pressure spring. The accumulator in cooperation with the pressure piston maintains the piston acting on the end of the threaded rod in its installation position via the hydraulic medium acting between the equalization space and the other space containing the piston. By moving the valve into its closed position, the space containing the piston in contact with the end of the threaded rod is disconnected from the equalization space and the hydraulic medium held within the space presses the piston against the end of the threaded rod for carrying out the next rod insertion operation.

Another feature of the present invention is the use of spring means for biasing the valve into the closed position. This feature simplifies the handling of the valve so that the operator is required to operate the valve only in placing it in the open position for effecting the removal of a threaded rod from the work driver. The closed position of the valve is effected automatically by the action of the spring means.

In a preferred arrangement, the valve is designed as a two-way valve. The two connections of the valve are formed by a connecting line which opens into the space containing the piston and into the equalization space. A closed position of the valve permits the insertion of the threaded rod to be effected while in the open position the inserted rod can be removed from the work driver. These two positions are sufficient for the operation of the setting tool. The valve can be operated by turning it about an axis or by displacing it in the axial direction. In a preferred embodiment, the valve member projects outwardly from the surface of the setting tool so that it can be actuated without any additional tool being required.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
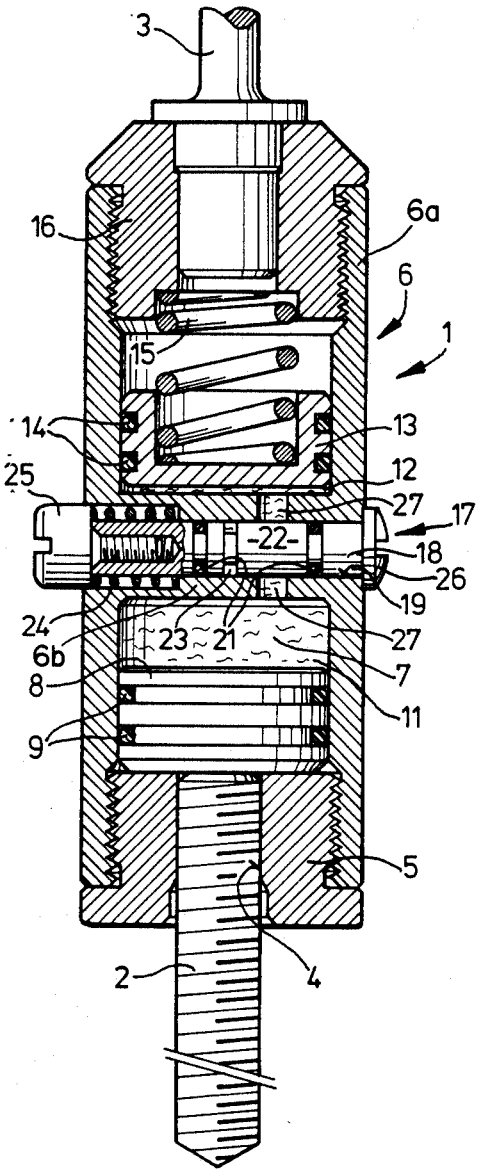
FIG. 1 is an axially extending sectional view of a setting tool arranged for screwing a threaded rod into a receiving material.
Figure 2:
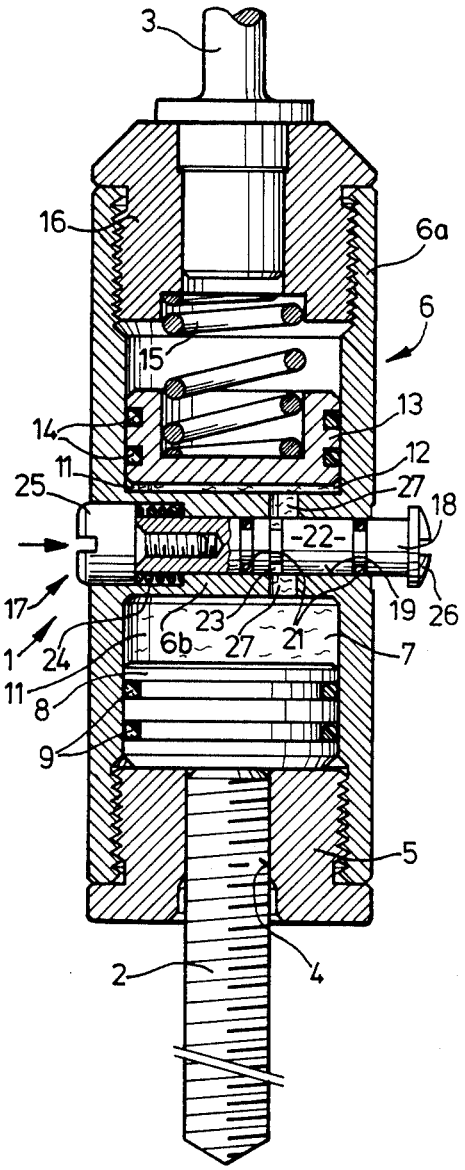
FIG. 2 is a sectional view similar to that in FIG. 1, however, showing the tool in the released position for removing the inserted threaded rod from the tool.

In FIGS. 1 and 2 a setting tool 1 is illustrated which serves to insert or screw a threaded rod 2 into a receiving material, not shown. For imparting the rotational movement for the insertion of the rod, a drive shaft 3 is connected to one end of the tool so that it can impart rotational movement and selectively direct impact movement to the tool.

A retainer part 5 is secured into one end of the tool 1 and a threaded bore 4 extends through the retainer part for receiving a threaded rod 2 so that the rod can be screwed into a receiving material. The retainer part 5 forms one part of a work driver 6. Retainer part 5 is rigidly connected with the work driver 6. The work driver 6 is formed by an axially elongated sleeve-like member 6*a* open at its opposite ends with a partition member 6*b* dividing the interior space within the member into two separate spaces, as viewed in the drawing, a lower space below the partition member and an upper space above it. The lower space is defined, opposite to the partition wall 6*b*, by the retainer part 5. Accordingly, a receiver space 7 is located between the retainer part 5 and the partition wall 6*b*. A piston 8 is located within the receiver space 7 and a pair of sealing rings 9 encircle the circumferential periphery of the piston and bear against the inside surface of the space. The piston 8 is displaceably supported within the receiver space 7. Piston 8 serves as a stop limiting the extent to which the threaded rod 2 extends through the retainer part 5. Between the upper surface of the piston 8 as viewed in FIG. 1 and the lower surface of the partition wall 6*b*, there is a hydraulic medium 11 arranged to press the piston 8 downwardly. On the opposite side of the partition wall 6*b* from the receiver space 7, there is a pressure equalization or balancing space 12 forming a part of the space located between the partition wall and the upper end of the sleeve-like member 6*b*. A pressure piston 13 is located above the partition wall 6*b* and forms the upper limit of the equalization space. A pair of sealing rings 14 encircle the circumferential periphery of the pressure piston 13 forming a seal with the inside surface of the sleeve-like member 6*a*. A sleeve 16 is inserted into the upper end of the sleeve-like member 6 forming a closure for the space located above the partition wall. The drive shaft 3 extends downwardly through an opening in the sleeve 16. An accumulator 15 is located within the upper space between the pressure piston 13 and the lower end of the sleeve 16 so that the accumulator in the form of a pressure spring acts downwardly on the pressure piston while a threaded rod is being inserted. The equalization space 12 between the lower end of the pressure piston 13 and the upper surface of the partition wall 6*b* also contains the hydraulic medium 11 so that the hydraulic medium acts against the pressure piston.

A valve 17 is located within the partition wall 6*b* and extends transversely of the axially extending sleeve-like member 6*a*. Valve 17 includes a bolt-like or cylindrically shaped tappet 18 displaceably supported within a bore 19 extending through the partition wall 6*b* transversely of the axis of the sleeve-like member. A pair of sealing rings 21 are located around the circumferential periphery of the tappet 18 in axially spaced relation and in engagement with the surface of the bore 19. Between the two sealing rings there is an axially extending sealing segment 22 and an annular passage 23. The partition wall 6*b* is stepped adjacent one end and a spring 24 is located within the stepped part for retaining the tappet 18 in the closed position shown in FIG. 1. The spring 24 bears at one end against the pressure knob 25 projecting outwardly from the outside surface of the sleeve-like member 6*a*. At the opposite end of the tappet, there is a head 26 bearing against the outside surface of the sleeve-like member 6*a*. In the closed position of the valve, the sealing segment 22 is located in the region of a connecting line 27 through the partition wall 6*b* interconnecting the receiver space 7 and the equalization space 12. In this position, the receiver space 7 is sealed so that the hydraulic medium cannot escape through the connecting line 27 into the equalization space 12. As a result, the hydraulic medium 11 captured within the receiver space 7 serves as a non-displaceable abutment for the piston 8 as a threaded rod 2 is screwed into a receiving material with the result that the end of the threaded rod extending through the threaded bore 4 bears tightly against the lower surface of the piston 8 due to the resistance developed as the threaded rod is screwed into the receiving material. The hydraulic medium 11 in the receiver space 7 develops a pressure acting on the piston 8 corresponding to the extent that the rod 2 bears tightly against the piston.

After the insertion of the threaded rod into the receiving material has been completed, it is necessary to relieve the tightly bearing action of the rod on the piston so that the rod can be separated from the setting tool 1. To effect such separation, the operator presses the knob 25 in the direction of the arrow shown in FIG. 2. The movement of the tappet 18 opposite to the biasing action of the spring 24 moves the annular passage 23 around the tappet into alignment with the connecting line 27. The pressure developed in the hydraulic medium 11 within the receiver space 7 during the screwing of the threaded into the receiving material can now dissipate into the equalization space 12 acting on the lower side of the pressure piston 13.

While the threaded rod 2 released in this manner is removed from the setting tool 1, the piston 8 remains in the position shown in FIGS. 1 and 2, because the accumulator 15 acts in the downward direction as viewed in the two figures pressing against the pressure piston 13 which limits flow out of the receiver space 7 so that the piston 8 remains in the illustrated position. When the pressing action against the knob 25 is released the spring 24 returns the tappet 18 from the position shown in FIG. 2 to that illustrated in FIG. 1. Accordingly, the next threaded rod insertion operation can be carried out.

While specific embodiments of the invention have been shown and described in detail to illustrate the application of the inventive principles, it will be understood that the invention may be embodied otherwise without departing from such principles.

We claim:

1. A setting tool for screwing a threaded rod into a receiving material, comprising a work driver, said work driver comprises an axially elongated sleeve-like member having a first end and a second end spaced apart in the axial direction, a partition wall located within said sleeve-like member extending transversely of the axis thereof and located intermediate the first and second ends thereof and dividing the interior of the sleeve-like member into a first axially extending space located between said partition wall and the first end of said sleeve-like member and a second axially extending space located between said partition wall and the second end of said sleeve-like member, a retainer part secured in the first end of said sleeve-like member and having a threaded bore therein extending through said retainer part in the axial direction of said sleeve-like member, means for transmitting rotational motion to said sleeve-like member, said retainer part comprising means for transmitting rotational movement from said work driver to a threaded rod secured in said threaded bore, stop means located within said first space between said retainer part and said partition wall for limiting the depth a threaded rod is screwed through said threaded bore in said retainer part, said stop means comprises a piston located within said first space and being displaceable therein in the axial direction of said sleeve-like member, a hydraulic medium located within said first space between said piston and said partition wall for biasing said piston against said retainer part, means located with said second space for supplying the hydraulic medium to said first space, and means in communication with hydraulic medium within said first space for selectively blocking or affording flow of the hydraulic medium between said first space and said second space, said means in communication with said hydraulic medium comprises a valve located in a passageway interconnecting said first and second spaces, said partition wall has a bore extending therethrough extending transversely of the axial direction of said sleeve-like member, said valve comprises a tappet extending through said bore in said partition wall and having a head at one end thereof arranged to bear against the outside surface of said sleeve-like member in the closed position of the above said valve and a knob on the opposite end of said tappet projecting outwardly from the outside surface of said sleeve-like member in the closed position of said valve, said tappet being displaceable in said bore between the closed position and the open position where said head is spaced outwardly from the outside surface of said sleeve-like member, spring means in contact with said tappet for biasing it into the closed position, and means in said tappet for providing flow communication between said first and second spaces in the open position of said valve.

2. A setting tool, as set forth in claim 1, wherein said second space in said sleeve-like member includes an equalization space adjacent said partition wall, said valve located within said partition wall, a connecting line extending through said partition wall between said first space containing the hydraulic medium and said equalization space, said valve being displaceable in the path of connecting line between a closed position blocking flow through the connecting line and an open position affording flow through the connecting line between the first space and the equalization space.

3. A setting tool, as set forth in claim 2, wherein a pressure piston is located within said second space between said equalization space and the second end of said sleeve-like member, a member secured within the second end of said sleeve-like member in spaced relation from said pressure piston, an accumulator is located within said second space extending between said member and said pressure piston and biasing said pressure piston toward said partition wall.

4. A setting tool, as set forth in claim 1, wherein a spring is located within said sleeve-like member bearing against said valve and biasing said valve into the closed position.

* * * * *